United States Patent [19]

Martino

[11] Patent Number: 4,563,668

[45] Date of Patent: Jan. 7, 1986

[54] OBSTRUCTION MARKER LIGHT

[76] Inventor: Peter V. Martino, 9960 65th Rd., Rego Park, N.Y. 11205

[21] Appl. No.: 560,436

[22] Filed: Dec. 12, 1983

[51] Int. Cl.[4] ..... E01F 9/00

[52] U.S. Cl. ..... 340/114 R; 340/87; 362/194; D26/24

[58] Field of Search ..... 340/114 R, 84, 87, 90, 340/117, 815.18, 815.2, 815.33, 331, 321; 116/63 P, 63 R; 40/612, 591, 592, 564; 362/171, 194, 202, 204; D26/24, 37, 40, 41; D10/114

[56] References Cited

U.S. PATENT DOCUMENTS

| | | | |
|---|---|---|---|
| D. 140,335 | 2/1945 | Chapman | D26/37 |
| 2,638,583 | 5/1953 | Edwards, Jr. | 116/63 P |
| 2,911,637 | 11/1959 | Wortmann | 340/331 |
| 2,938,111 | 5/1960 | Keilman | 362/194 |
| 2,987,702 | 6/1961 | Yohe | 340/331 |
| 3,197,757 | 7/1965 | Porta | 340/321 |
| 3,500,378 | 3/1970 | Pickering et al. | 340/331 |
| 4,047,150 | 9/1977 | Kelley | 340/84 |
| 4,398,238 | 8/1983 | Nelson | 362/202 X |

FOREIGN PATENT DOCUMENTS

| | | | |
|---|---|---|---|
| 2358616 | 2/1978 | France | 362/202 |

*Primary Examiner*—James L. Rowland
*Assistant Examiner*—Brian R. Tumm
*Attorney, Agent, or Firm*—Anthony J. Casella; Gerald E. Hespos

[57] ABSTRACT

A marker light including a light assembly having a unitary blow molded plastic canister in which a power source and circuitry are retained. The canister includes generally cylindrical upper and lower portions, with the lower portion being of small diameter, smaller and offset with respect to the upper portion. The lower portion includes a plurality of inwardly directed flat-bottom indentations to define a generally rectangular channel for guiding and holding the battery. The indentations further provide generally annular array of outwardly extending grooves into which a circuit board assembly can be securely mounted. The circuit board assembly includes two boards in fixed spaced relationship with the electrical components being disposed intermediate the two boards. The switch of the assembly is recessed in the upper portion of the canister for adequate protection.

11 Claims, 5 Drawing Figures

OBSTRUCTION MARKER LIGHT

BACKGROUND OF THE INVENTION

The various operating branches of the Department of Defense frequently are required to clearly identify certain strategic locations with markers that are visible during both day and night. In many instances these markers will be employed rapidly in response to a particular emergency. For example, it may be necessary to mark the boundaries of a clear roadway, to identify airport runways that are operable, to locate a helicopter landing zone, to indicate certain areas where the ground conditions may be soft, cratered or strewn with debris, and a host of other possible applications. Markers of this type may be required in virtually any climactic and environmental condition, and may be subjected to physical abuse during storage, use and installation. For example, in response to certain emergency situations, markers of this type may literally be thrown from moving vehicles or hovering helicopters.

United States specification MIL-L-52543C is directed to a ground-obstruction marker light which is geared to the above described needs. The marker light described in MIL-L-52543C includes a light assembly and a ballast bag. The ballast bag of MIL-L-52543C is a reclosable bag member which is releasably attachable to the light assembly. The ballast bag is designed to accomodate approximately 20 lbs. of ballast, such as sand, rocks or any other similar material which is available in the area in which the unit would be used.

The light assembly of MIL-L-52543C is depicted and described in two acceptable alternative designs. The first design of MIL-L-52543C includes a generally cylindrical canister body, which as shown, appears to be designed for injection molding. The canister body of this first design of MIL-L-52543C is of generally truncated conical external configuration. The inside of the canister body is dimensioned to accept a six volt dry cell battery. The inside of the canister body depicted in this first design of MIL-L-52543C further includes a plurality of narrow longitudinally extending ribs, each of which includes a notch disposed at a longitudinal location corresponding to an end of a battery mounted in the canister body. The light assembly shown in the first design of MIL-L-52543C further includes an octagonal circuit board that can be retained in the notches in the narrow longitudinally extending ribs of the canister body. A light deflector, lamp and plastic dome are retained on the canister body shown in the first alternate design of MIL-L-52543C by a threaded canister cap. The lamp is electrically connected to a contact ring on the circuit board, and is activated by a three way switch (on, off and flash) which extends outwardly from the inner portion of the canister body.

A second alternative design for the light assembly shown in MIL-L-52543C includes a two part canister having a canister body for housing a six volt dry cell battery, and a canister top for housing the circuitry. The canister top and body can be threadably nested with respect to one another such that the canister top securely retains the battery in the canister body. The canister top of the second alternate shown in MIL-L-52543C flares symmetrically outwardly as it extends away from the canister body. A terminal board, deflector, lamp, gasket and dome are attached to the canister top of this second alternate by an internally threaded canister cap. The switch of the second alternate of MIL-L-52543C extends through the wall of the canister top. Thus, the symmetrical outwardly flared uppermost portion of the canister top shown in this second alternate partially protects the switch from rain and such.

Although MIL-L-52543C establishes several requirements as to performance, testing procedures, overall dimensions, and material types, it indicates that the specific illustrated figures show types of markers which have been found acceptable, but they are not intended to preclude other types of marker lights. In reviewing the known acceptable marker lights, as illustrated in MIL-L-52543C, it was observed that in many respects the light assembly portion of the illustrated markers are not adequately constructed to withstand the wide range of physical abuses to which these markers might typically be subjected. Additionally these prior art markers are not well adapted to wide range of environmental conditions in which such markers might be used.

For example, it was realized that the switch of the light assembly shown in MIL-L-52543C was improperly protected from contact and/or damage during use. Specifically, it was found that the switch was entirely exposed in one alternate design of MIL-L-52543C and only partly protected in the other alternate. Thus, if the light assembly of MIL-L-52543C is thrown from a moving vehicle, there is a substantial possibility that the switch would contact either the ground or an object on the ground thus causing the switch to either break or be urged into the wrong operational position.

It also was found that the battery was only loosely positioned in the light assembly of MIL-L-52543C such that it could be shifted out of electrical contacting position as a result of any sudden force. Similarly in the one alternative of the light assembly of MIL-L-52543C, the terminal board is only loosely positioned and as a result electrical components mounted thereon easily could be damaged. In the other alternate shown in MIL-L-52543C, the terminal board and circuitry are properly protected, but the protective housing or canister top of the assembly is extremely costly and complex to manufacturer.

The generally smooth external surface of the light assembly of MIL-L-52543C would be difficult to grasp particularly during in situ assembly, installation or maintanance. Additionally it was realized that in certain instances the area to be marked might temporarily be covered by water. This could occur, for example, if the area to be marked is a recess or crater on an airport runway, a marsh or a ditch along an edge of a road. The lights disclosed in MIL-L-52543C, however, were substantially unsuitable for use in such an environment, even for a short period of time. More particularly the prior art marker lights would evidence an inadequate degree of bouyancy in water.

In view of the above, it is an object of the subject invention to provide an improved marker light in conformance with the requirements of United States specification MIL-L-52543C.

It is another object of the subject invention to provide a marker light in which the switch is adequately protected from inadvertant contact and damage.

It is an additional object of the subject invention to provide a marker light in which the battery can be properly secured and substantially prevented from shifting.

It is a further object of the subject invention to provide a marker light in which the electric circuitry is adequately protected to avoid damage during assembly, disassembly and use.

It is still another object of the subject invention to provide a marker light which can be easily and securely grasped during assembly, disassembly and use.

It is still an additional object of the subject invention to provide a marker light with improved buoyancy.

It is yet a further object of the subject invention to provide a marker light which can be manufactured inexpensively.

It is a further object of the subject invention to provide a marker light which can be manufactured out of plastic by blow molding techniques.

SUMMARY OF THE INVENTION

The subject invention is directed to a marker light which is manufactured in accordance with United States specification MIL-L-52543C. More particularly, the marker light of the subject invention includes a new and improved light assembly which can be used in conjunction with a ballast bag substantially similar to the ballast bag shown and required by United States specification MIL-L-52543C.

The light assembly of the subject marker light includes a unitary blow molded plastic canister housing of approximately uniform thickness, having generally cylindrical upper and lower portions disposed in parallel but non-concentric alignment. The lower portion of the canister is adapted to receive a six volt dry cell battery identified in MIL-B-18/34. This battery has four upstanding generally rectangular side walls and opposed generally rectangular top and bottom walls. The diameter of the generally cylindrical canister lower portion is approximately equal to the diagonal distance across the top or bottom of the battery, thus ensuring a secure mounting of the battery in the canister lower portion. To further ensure a secure mounting and initial positioning of the battery, the portion of the canister base approximately at the level of the top part of the battery includes at least one array of inwardly extending flat-bottom indentations which define a generally rectangular internal channel in the lower portion of the canister which is dimensioned to guide the battery into the canister and securely hold the battery during use. These indentations further provide external hand holds or grips which facilitate handling of the light assembly during installation, assembly, maintenance and general use.

Preferably the inwardly directed flat-bottom indentations in the canister lower portion are disposed in at least one array, with the indentations in the array being at approximately the same axial location along the generally cylindrical lower portion. More particularly it is preferred that the array include two pairs of opposed parallel inwardly directed flat-bottom indentations, with the respective pairs being perpendicular to one another. It further is preferred that the lower portion include a plurality of such arrays of inwardly directed flat-bottom indentations, with the arrays being spaced axially apart. Intermediate adjacent arrays of the inwardly directed indentations, there is thus defined a generally annular array of outwardly directed ridges on the outside of the canister and an annular array of outwardly directed grooves on the inside of the canister. The annular array of external ridges provides a secure area to which the ballast bag may be mounted. The annular array of grooves defined on the inside of the canister defines portions into which the circuit board and contact ring may be mounted as explained below.

The upper portion of the canister has a larger diameter cylinder than the lower portion, and preferably is offset with respect to the lower portion. More particularly, the axes of the generally cylindrical upper and lower portions are parallel, and the upper and lower portions preferably share a common line of tangency. Thus if the upper portion was projected down over the lower portion, the two would be internally tangent. The switch is recessed into the wall of the generally cylindrical canister upper portion at the portion thereof approximately opposite the line of tangency through the upper and lower portions of the canister. In fact, the internal recessed disposition of the switch is enabled by the offset construction of the canister. The magnitude of this recess is such that the outermost portion of the switch is disposed inwardly from the circumference of the generally cylindrical upper portion, and the innermost portion of the switch is clear of the rectangular internal channel into which the battery is moved. Thus the switch is disposed substantially entirely in the offset portion of the canister.

The electric circuitry of the light assembly is disposed on two parallel boards which are fixedly positioned into a tiered arrangement. More particularly the lower tier defines a contact ring board with a size and shape substantially identical to the opposed top and bottom walls of the battery. Thus, the contact ring board can be locked into the annular array of grooves on the inside of the canister lower portion. The upper tier is a circuit board which includes the various circuitry and electronic components for operation of the light assembly. The contact ring board and the circuit board are maintained in fixed space relationship to one another by a pair of support posts. The support posts further hold a pair of frictional spring mounting clips which hold spare bulbs.

The canister upper portion further includes a ridge onto which a light deflector and bulb are mounted. A plastic dome then is secured over the deflector and bulb with an internally threaded cap. A waterproof gasket is disposed intermediate the dome and cap to render the subject light assembly substantially waterproof.

The substantially larger diameter of the canister top creates a much larger volume of unoccupied space which contributes significantly to the improved buoyancy of the subject light assembly, thereby enabling the light assembly to be used for at least short periods of time buoyed in water.

DETAILED DESCRIPTION OF THE PREFERRED EMBODIMENT

Figure 1:
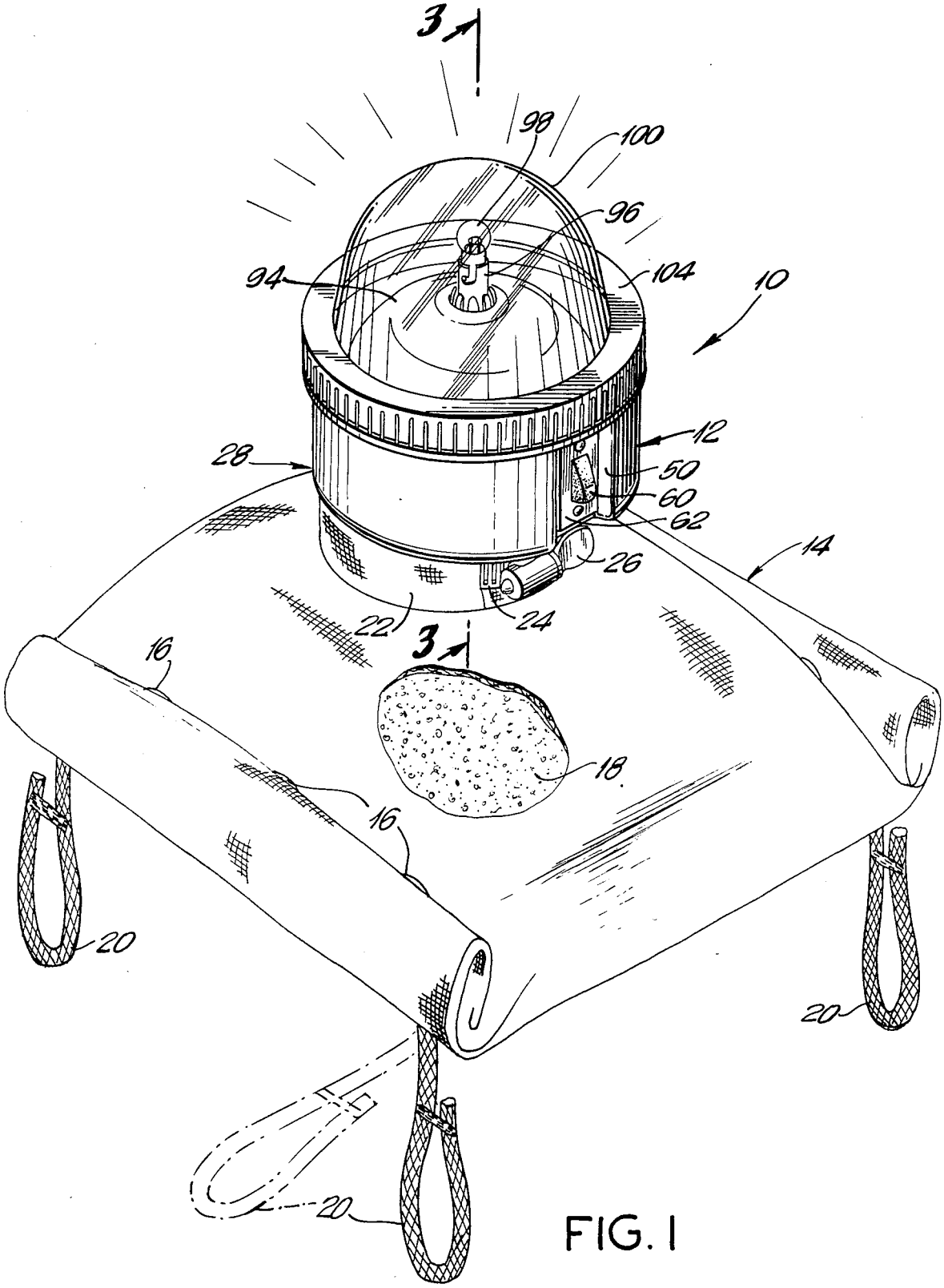
FIG. 1 is a perspective view, partially in section, of the marker light of the subject invention including the ballast bag and ballast.

The marker light of the subject invention is indicated generally by the numeral 10 in FIG. 1. More particularly, the marker light 10 includes a light assembly 12 and a ballast bag 14. The ballast bag 14 includes closure means 16 and is adapted to retain approximately 20 lbs. of ballast 18, such as sand, gravel or any other locally available sufficiently heavy material. The ballast bag 14 further includes a plurality of tie downs 20 which are securely retained to the ballast bag and are adapted to be used in conjunction with anchor pins (not shown) which can be driven into the ground to more securely prevent movement of the marker light 10. The ballast bag 14 includes a folded over collar portion 22 into which a circular clamp 24 is inserted. The clamp 24 is adjustable by a thumb screw 26.

Figure 2:
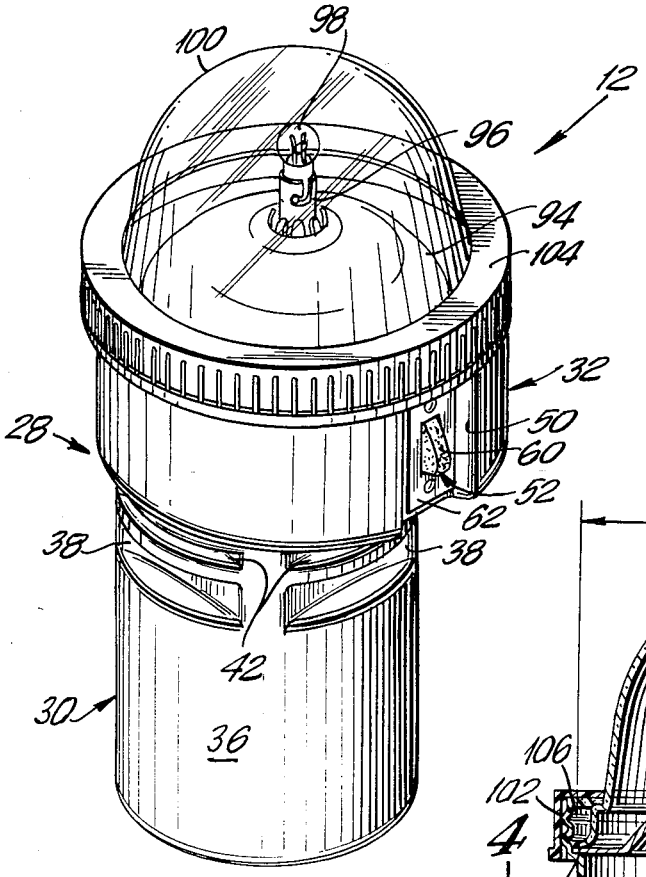
FIG. 2 is a perspective view of the light assembly of the marker light shown in FIG. 1.

The light assembly 12, as illustrated more clearly in FIG. 2 includes a blow molded plastic canister 28 into which the various operating portions of the marker light 10 are disposed as explained in detail below. More particularly, the canister 28 is blow molded from a high impact plastic so as to have a minimum wall thickness of approximately 0.035 to 0.040 inches. The blow molding technique employed in the manufacturer of the subject canister 28 results in the various structural elements described herein to have a substantially uniform thickness of material throughout. As a result, the total amount of plastic used in the subject canister 28 can be significantly reduced as compared to the amounts used in prior art canisters.

The canister 28 is an open ended structure with a lower portion 30 disposed adjacent the closed end thereof and an upper portion 32 disposed adjacent the open end. The lower and upper portions 30 and 32 of the canister 28 each are generally cylindrical in configuration and have parallel longitudinal axes. However, the lower portion 30 is of substantially smaller diameter than the upper portion 32 as explained herein.

The lower portion 30 of canister 28 includes a bottom wall 34 and a generally cylindrical sidewall 36. As shown most clearly in FIG. 3, the diameter of the lower portion 30, as indicated by dimension "a", is approximately $3\frac{3}{8}$ inches. With reference to FIGS. 2 through 5, the lower portion 30 of canister 28 further includes an array of substantially identical inwardly directed flat-bottom indentations. The array of indentations includes two opposed pairs of indentations 38. The indentations 38 in each pair are parallel to one another, and the respective pairs are mutually perpendicular. As a result, as shown most clearly in FIG. 5, the two opposed pairs of indentations 38 define a rectangular channel on the inside of the canister 28. The internal distance between the opposed indentations 38, as indicated by dimension "b" in FIG. 3 preferably is between $2\frac{5}{8}$ and $2\frac{3}{4}$ inches. This dimension is substantially identical to or slightly greater than the width of the six volt dry cell battery 40 that is used with the light assembly. Additionally, as noted above, the diagonal dimension of the battery 40 is substantially equal to the internal diameter "c" of the lower portion 30 of canister 28. Thus, as shown most clearly in FIGS. 3 through 5, the battery 40 can be guided into the lower portion 30 and held firmly in position both by the internal walls of the lower portion 30 and particularly by the indentations 38. The indentations 38 preferably extend at least $\frac{5}{8}$ inch parallel to the axis of the canister to provide sufficient room for a person to grasp the light assembly 12 during installation, assembly or disassembly. Thus indentations 38 perform the dual function of defining an internal channel and enabling more positive manipulation of the light assembly 12.

The part of the lower portion 30 nearest to the upper portion 32 is further defined by additional arrays of flat-bottom indentations 42 and 44 which extend inwardly into the lower portion 30. More particularly the indentations 42 are disposed in opposed parallel pairs with the indentations 42 in one pair being perpendicular to the indentations 42 in the other pair. The depth of indentations 42 is substantially identical to the depth of indentations 38. Additionally, the indentations 42 are respectively parallel to and axially spaced from the indentations 38 so as to define an annular array of outwardly extending grooves 46. More particularly, the four grooves 46 effectively define a circle of diameter "c", which, as noted below, is substantially equal to the diagonal distance across the battery 40. The indentations 44 are in register with the indentations 42 respectively, and are spaced therefrom so as to define a second annular array of outwardly extending grooves 48 which are substantially identical to the outwardly extending grooves 46. As explained further below the grooves 44 or 46 securely retain the circuitry of the light assembly 12.

Figure 3:
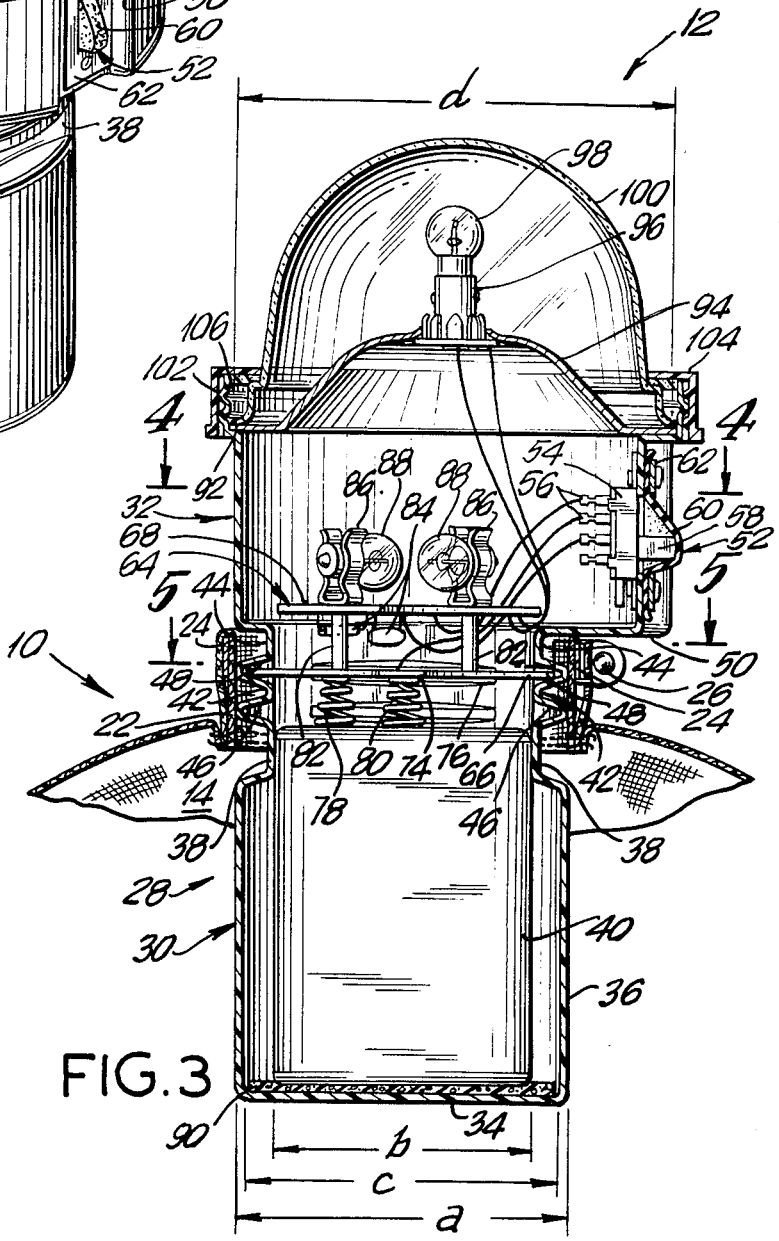
FIG. 3 is a cross-sectional view taken along lines 3—3 of FIG. 1.

The upper portion 32 of the canister 28, as shown in FIG. 3, has an outside diameter "d" of approximately $4\frac{3}{8}$ inches which is about one inch or 25% greater than the outside diameter "a" of the lower portion 30.

The upper portion 32 is further characterized by a recess 50 which extends inwardly into the upper portion 32 a sufficient distance to protect the switch 52, as illustrated in FIGS. 1 through 4. More particularly, the recess 50 is configured to protect the switch 52 from an object approaching the switch 52 from the top or either side. In most instances, the ballast bag 14 protects the switch 52 from an object approaching the marker light 10 from the bottom. The electrical components 54 of the switch 52 and the electrical leads 56 connected to the switch 52 are disposed on the inside of the upper portion 32 of canister 28. The switch lever 58, however, extends through the upper portion 32 at recess 50 to be accessible from the outside of the canister 28. A waterproof sheath 60 securely extends over the lever 58 and is attached thereto by switch cover 62.

Figure 4:
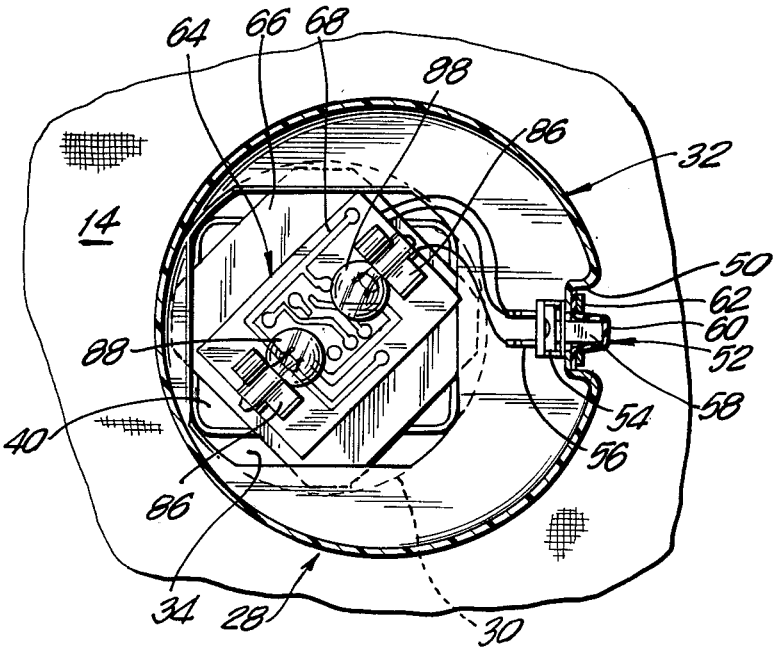
FIG. 4 is a cross-sectional view taken along lines 4—4 of FIG. 3.

As shown most clearly in FIGS. 3 and 4, the lower portion 30 is aligned to be substantially tangent to a projection of the upper portion 32. The line of tangency is disposed approximately exactly opposite the switch 52. Consequently there is ample room inside the upper portion 32 of canister 28 to accommodate the recess 50 and the recessed switch 52.

Figure 5:
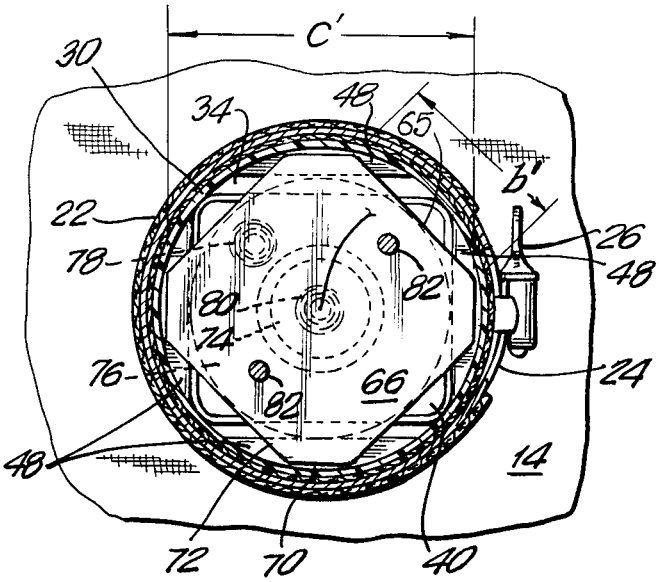
FIG. 5 is a cross-sectional view taken along lines 5—5 of FIG. 3.

The circuitry and the electrical connections of the lighting assembly 12 are disposed on a tiered circuit assembly 64. The tiered circuit assembly 64 includes a lower contact ring board 66 and an upper circuit board 68. More particularly, the contact ring board 66 is of generally the same shape as the top of the internal channel defined in lower portion 30 by indentations 38. Thus, as shown most clearly in FIGS. 4 and 5, the contact ring board 66 effectively defines a square which has been truncated at its respective corners. The distance between the opposed truncated corners, as indicated by dimension "c'" is equal to or slightly less than the distance "c" which defines the internal diameter of lower portion 30. Additionally, the length of each side 65 of the contact ring board 66 as indicated by dimension "b'" is approximately equal to or less than the internal distance between indentations 38 of the lower portion 30. By this configuration, the contact ring board 66 can be aligned substantially in register with the top of battery 40 and moved longitudinally through the generally rectangular channel in the lower portion 30 defined by the various indentations 38, 42 and 44. Once the contact ring board has been longitudinally moved to a position where it is aligned with either the annular array of grooves 46 or the annular array of grooves 38, it can be rotated within its plane such that the truncated corners 70 enter into the grooves 44 or 46 as shown in FIGS. 3 through 5.

The contact ring board 66 is provided with a center contact 74 and an outer contact ring 76 which are concentrically arranged and spaced apart to avoid shorting. The center contact and contact rings 74 and 76 are positioned to electrically contact the terminals 78 and 80 of battery 40.

The circuit board 68 is disposed in fixed spaced relationship with respect to the contact ring board 66 by posts 82. The circuit board 68 includes the printed circuits, and the various electric components, indicated generally by the numeral 84, are electrically connected to the circuit board 68 and disposed intermediate the circuit board 68 and the contact ring board 66. This fixed spaced relationship between the contact ring and circuit boards 66 and 68 ensures that the electrical components 84 are adequately protected from damage under virtually all conditions. The spacing further provides adequate room for the wires connecting the various electric components 84, the switch 52, the contact ring 76 and such.

As shown in FIGS. 3 and 4, spring clips 86 are mounted on the side of circuit board 68 opposite the contact ring board 66. The clips 86 are adapted to hold spare bulbs 88. Preferably, as illustrated most clearly in FIG. 3, the spring clips 86 are affixed to the circuit board 68 by a rivet or screw (not shown) which also is used to mount circuit board 68 to posts 82.

Preferably, a resilient pad 90 is adhesively attached to the bottom 34 on the inside of the lower portion 30 of canister 28. The pad 90 further minimizes movement of the battery 40, and can keep the battery 40 separated from any small amount of water that might accumulate in the bottom of canister 28.

The upper portion 32 further includes a circumferential ridge 92 into which a deflector 94 is adapted to sit. The deflector 94 houses an electrical socket 96 which in turn receives a bulb 98. The electrical socket 96 is electrically connected to the battery 40, the switch 52 and the other electrical circuitry to enable operation of the bulb 98.

The light assembly 12 further includes a dome 100 which may be either a clear or tinted plastic. The dome is configured to have a diameter approximately equal to the diameter of the deflector 94 such that the dome 100 can also be seated within the ridge 92 of the canister 28. The uppermost portion of the canister 28 is defined by external threads 102 which are adapted to threadably engage a ring cap 104. Threadable engagement of the ring cap 104 onto the canister 28 securely retains the dome 100 and deflector 94 against the ridge 92 as indicated most clearly in FIG. 3. An annular gasket 106 is disposed intermediate the cap 104 and the dome 100 to substantially prevent intrusion of water into the light assembly 12.

In summary a new and improved marker light is provided including a unique light assembly. The canister of the light assembly is blow molded from a unitary piece of high impact plastic. The canister includes upper and lower portions, with the lower portion being of smaller diameter than the upper portion and aligned to be internally tangent with a projection of the upper portion. The lower portion of the canister further includes a plurality of inwardly directed flat-bottom indentations which extend into the canister equal amounts to define a generally rectangular channel in the lower portion of the canister. This channel guides a battery into the lower portion and helps to securely hold the battery into position under all conditions of use. The indentations further define a generally annular array of outwardly extending grooves for retaining the circuit assembly. The larger size and offset alignment of the upper portion enables the switch to be sufficiently recessed into the upper portion to prevent damage during use. The circuit board assembly includes a contact ring board and a circuit board which are mounted in fixed spaced relationship to one another. The electrical components of the circuitry are safely protected intermediate the spaced apart contact ring and circuit board. The light assembly further includes a deflector and dome which are attached to the canister by an internally threaded ring.

While the preferred embodiment of the subject invention has been described and illustrated, it is obvious that various changes and modifications can be made therein without the departing from the spirit of the present invention which should be limited only by the scope of the appended claims.

What is claimed is:

1. A marker light assembly for use with a battery and light bulb, comprising:

a blow molded unitary plastic canister having generally uniform thickness and having generally cylindrical upper and lower portions with the lower portions being dimensioned to receive the battery and with the diameter of the upper portion being larger than the diameter of the lower portion, said upper and lower portions being non-concentrically aligned with respect to one another and with their respective longitudinal axes being parallel, said lower portion including at least one array of four inwardly directed indentations, each said indentation in said array comprising a flat bottom the plane of which is generally parallel to the longitudinal axis of said lower portion, each said array of indentations comprising first and second pairs of indentations with the bottoms of the indentations in each said pair being parallel to one another and with the bottoms of the indentations in said first pair being perpendicular to the bottoms of the indentations in the second pair, the flat bottoms of the four indentations in said array defining four sides of a generally rectangular channel extending at least partly along the inside of said lower portion, said rectangular channel extending generally parallel to the longitudinal axis of said lower portion, said flat-bottom indentations further defining a plurality of hand grips on the outside of the lower portion;

said lower portion including a plurality of said arrays of the inwardly directed flat-bottom identations, with said arrays being spaced apart, such that a generally circular array of outwardly extending grooves are disposed on the inside of said canister intermediate adjacent arrays;

a circuit board assembly mounted in said canister, said circuit board assembly being electrically connected to the battery and the bulb; and a switch rigidly mounted in the upper portion of said canister and being electrically connected to said bulb and said circuit board assembly, whereby the generally rectangular channel defined on the inside of said lower portion by the array of indentions securely guides and retains the battery therein and whereby the indentations fascilitate secure gripping of the outside of the canister by a user thereof.

2. A marker light assembly as in claim 1 wherein said circuit board assembly comprises a contact ring board for making electrical contact with the battery, and a circuit board disposed in fixed spaced relationship to said contact ring board.

3. A marker light assembly as in claim 2 wherein said circuit board assembly further includes a plurality of electrical components, said components being electrically connected to the circuit board and being disposed intermediate said circuit and contact ring boards, whereby said electrical components are protected by said circuit board and said contact ring board.

4. A marker light assembly as in claim 3 wherein said circuit board and said contact ring board are maintained in fixed spaced relationship by a plurality of ridged support posts.

5. A marker light assembly as in claim 4 wherein said circuit board assembly is securely but removably mounted in said generally circular array of outwardly extending grooves.

6. A marker light assembly as in claim 1 wherein said upper and lower portions are disposed so as to share a common line of tangency.

7. A marker light assembly as in claim 1 wherein the diameter of said generally cylindrical upper portion is approximately 25% greater than the diameter of said generally cylindrical lower portion.

8. A marker light assembly as in claim 1 wherein said upper portion includes an inwardly directed recess, and wherein said switch is mounted in and protected by said recess.

9. A marker light assembly as in claim 8 wherein said switch includes a lever portion for operating the switch and an electrical component portion, said electrical component portion of said switch being disposed on the inside of said canister so as to be clear of the generally rectangular channel defined in the lower portion of said canister, said lever portion of said switch extending out of said upper portion and into said recess to a point approximately in line with the circumference of said upper portion.

10. A marker light assembly as in claim 1 wherein the lower portion of said canister includes a closed bottom and wherein the indentations in each said array are at approximately the same axial distance from the bottom of said generally cylindrical lower portion of said canister.

11. A marker light assembly as in claim 1 wherein said unitary plastic canister has a substantially uniform thickness of approximately 0.035 inches.

* * * * *